United States Patent [19]

Rebish

[11] 4,416,173

[45] Nov. 22, 1983

[54] WRENCH ADAPTER

[75] Inventor: Edward J. Rebish, Euclid, Ohio

[73] Assignee: Russell, Burdsall & Ward Corporation, Cleveland, Ohio

[21] Appl. No.: 327,810

[22] Filed: Dec. 7, 1981

[51] Int. Cl.[3] ..... B25B 13/58

[52] U.S. Cl. ..... 81/185; 81/DIG. 11

[58] Field of Search ..... 81/125, 185, DIG. 11

[56] References Cited

U.S. PATENT DOCUMENTS 1,898,726 2/1933 Hess .
2,220,654 11/1940 Kirkland .
3,413,876 12/1968 Shinn .
3,665,791 5/1972 Carr ..... 81/125
3,834,253 9/1974 Carr ..... 81/125
3,889,557 6/1975 Young ..... 81/53.2
3,916,736 11/1975 Clemens ..... 81/185

*Primary Examiner*—James G. Smith
*Attorney, Agent, or Firm*—Pearne, Gordon, Sessions, McCoy, Granger & Tilberry

[57] ABSTRACT

A wrench adapter is disclosed which can be inserted into and removed from standard size wrenches. The adapter includes a plurality of pins interconnected by a resilient retainer which operates to position the pins in an array arranged to fit into the corners of a mating wrench opening. The adapter permits the conversion of wrenches between inch and metric sizes, and also allows a wrench to be used with a damaged fastener or with cylindrical elements such as studs.

22 Claims, 10 Drawing Figures

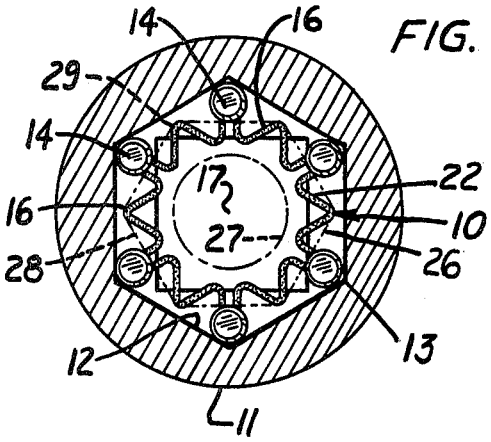
FIG. 1.
FIG. 2.
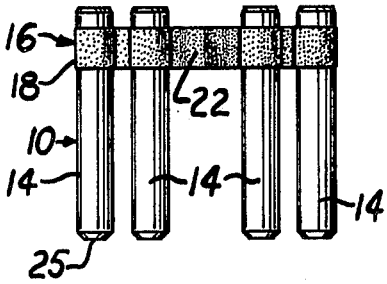
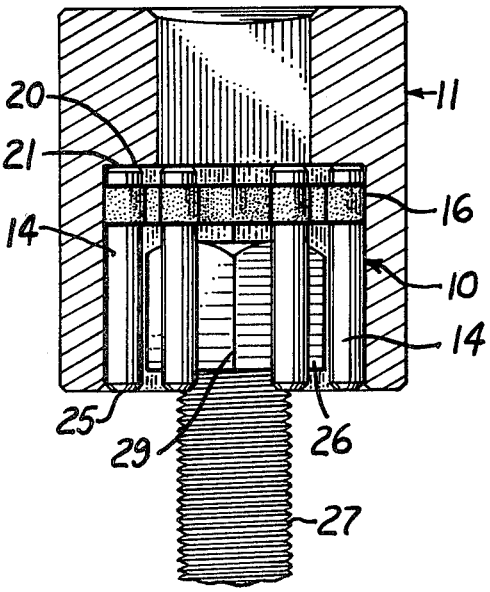
FIG. 4.
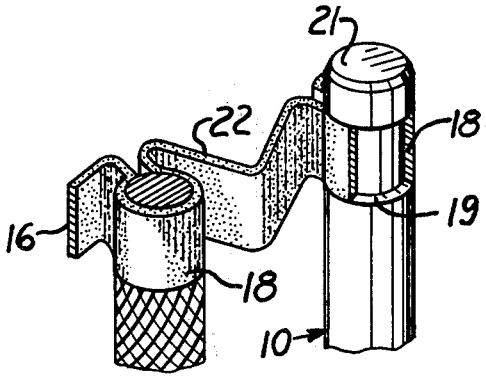
FIG. 3.
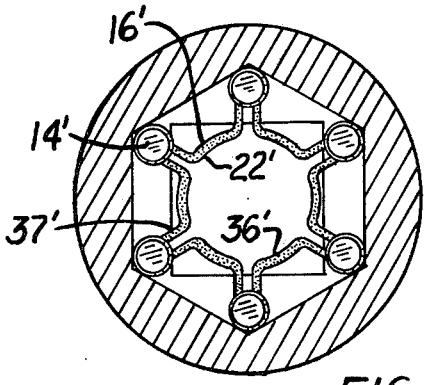
FIG. 5.

WRENCH ADAPTER

BACKGROUND OF THE INVENTION

This invention relates generally to wrenches, such as socket wrenches or the like, and more particularly to an adapter which allows the conversion of wrenches between inch and metric sizes, which can also be used with studs and damaged threaded fasteners.

PRIOR ART

Tools are known which combine a casing or housing formed with internal lobes and rollers which permit the tool to grip studs or damaged fasteners, such as fasteners having wrenching portions which are damaged by wearing away of the corners thereof.

Such tools generally require special housings and are therefore not standard production tools. Still further, such tools are special purpose tools which generally are expensive. Examples of such tools are described in U.S. Pat. Nos. 1,898,726; 2,220,654; 3,413,876; and 3,889,557.

SUMMARY OF THE INVENTION

In accordance with the present invention, a novel and improved socket adapter is provided which converts socket wrenches or the like between inch sizes and metric sizes. For example, with this invention the owner of an inch-sized wrench set can economically convert the existing set for use on metric size fasteners. Conversely, this invention also permits the use of metric size wrenches on inch size fasteners. Therefore, with this invention, it is not necessary to acquire separate sets of wrenches for each size-type of fastener.

Further with the present invention, it is possible to use the adapter in combination with standard wrenches on damaged fasteners or studs. In many instances, the corners of the heads of bolts or the corners of nuts become rounded or worn away to the point where a standard wrench will not properly fit and drive the fastener. With this invention, the adapter can be used with a standard wrench even on badly damaged fasteners.

Still further, with an adapter in accordance with this invention, the adapter can also be used with standard wrenches to drive round studs.

In the illustrated embodiments of this invention, a plurality of hardened rollers are assembled in a retainer which is sized to slide into and out of the standard size wrench and to position the rollers substantially at the corners of the wrenching opening. The adapter is sized to provide a small interference fit so that the adapter will be retained by friction within the wrenching opening even though it is easily inserted and removed.

The retainer functions primarily to maintain the roller assembly intact, and to establish a light frictional contact with the wrench, but is not subjected to any material loading during the actual use of the modified wrench.

Several embodiments of this invention are illustrated. In all such embodiments, the hardened rollers are interconnected by a retainer so that the adapter can be easily slipped into and out of the wrench and so that the rollers can move into proper gripping of the fastener. In two of the embodiments, the retainer is formed with a shape providing a mechanical spring to provide resiliency. In such embodiments, the retainer may be formed of relatively thin spring metal or from molded plastic. In a third embodiment, the retainer is formed of elastomeric material, which in itself provides resiliency. In another embodiment, the retainer is formed with slots which allow movement of the rollers into gripping position.

BRIEF DESCRIPTION OF THE DRAWINGS

FIG. 1 is an end view of an adapter in accordance with the first embodiment of this invention installed in a socket wrench and illustrating in phantom the wrenching portion of the fastener located within the adapter;

FIG. 2 is a side elevation of the adapter of FIG. 1, removed from the socket;

FIG. 3 is an enlarged, fragmentary, perspective view of the adapter of FIGS. 1 and 2 illustrating the structure of the mounting of the pins in the retainer;

FIG. 4 is a side elevation, partially in longitudinal section, of a socket with an adapter positioned therein and with the adapter and socket positioned over the wrenching portion of a nut;

FIG. 5 is an end view of a second embodiment of the adapter installed in a socket wrench;

DETAILED DESCRIPTION OF THE DRAWINGS

Figure 6:
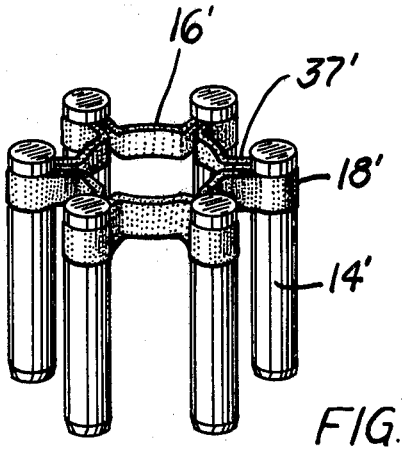
FIG. 6 is a perspective view of the adapter of the second embodiment.

FIGS. 1 through 4 illustrate a first embodiment. In this embodiment, the adapter 10 is illustrated installed in a typical socket wrench 11. The socket provides a wrenching opening which is hexagonal in shape, providing six flats 12 which intersect at six corners 13. The adapter 10 includes six hardened, cylindrical pins 14 which are interconnected by a retainer 16. The retainer positions the pins 14 in an array in which the pins are parallel to each other and are symmetrically located around a central axis 17. The retainer is shaped to fit into the wrenching opening and to position the six pins 14 adjacent to the associated corners 13 of the socket 11, as best illustrated in FIG. 1.

In this embodiment, the retainer provides a generally circular mounting portion 18 which closely fits within a groove 19 formed substantially adjacent to one end 21 of the associated pin 14. Between the mounting portions 18 of the retainer, the retainer is provided with a serpentine, generally M-shaped spring portion 22 which joins at its ends with the adjacent ends of the mounting portions 18.

The retainer 16 is formed of a strip of material which provides resilient characteristics so that, although the retainer tends to position the pins at the corner 13, the pins are free to move against the spring action of the retainer from such corners along the flats 12. Further, the retainer is sized to produce a sufficient frictional engagement with the surface of the wrenching portion of the socket so that it tends to remain in place once inserted but is freely removable from the socket. The retainer may be formed of spring metal in the form of a thin ribbon or wire, or it may be formed of plastic. One plastic material which has been found to be suitable for the retainer is polystyrene.

Preferably, the grooves 19 formed in the pins 14 are sufficiently deep that the surface of the mounting portion 18 extending around the pin does not extend beyond the adjacent surface of the pin itself. This prevents excessive forces from being applied to the retainer. Because the groove provides opposed radially extending end walls, the pins are anchored axially within the retainer and because the mounting portion 18 extends around the pin through an angle of greater than 180 degrees, the pin is properly retained in the retainer. The resiliency of the retainer, however, is such that the pins can be assembled within the retainer after the retainer is formed, either by radial movement out between adjacent portions of the M portion 22 of the retainer or by axial insertion into the mounting portion 18. The retainer is located adjacent to one end of the pins, leaving the free end of the pins, which is sufficiently long, to properly receive a typical hexagonal nut or hexagonal bolt. Further, the retainer is preferably formed so that it has a free center portion at least big enough to pass the end of a bolt on which the nut is applied. The pins 14 are preferably sized so that the outer ends 25 are substantially at the open end of the socket 11 when the inner ends engage the radial wall 20 at the inner end of the socket opening. This engagement maintains proper axial position of the adapter as the socket and adapter are positioned over the fastener. Further, the outer ends 25 are preferably chamfered to facilitate such positioning.

In FIG. 1, a nut 26 having a hexagonal wrenching portion is illustrated in phantom between the pins and the shank of a mating bolt 27 is also illustrated in phantom. It should be noted that opposed flats 28 of the nut 26 fit between opposed pins 14 with a small clearance, and that the corners 29 of the nut are positioned between adjacent pins.

When the socket is rotated from the position illustrated in FIG. 1 with respect to the nut 26 in either direction, the pins are carried with the socket until they engage the adjacent flat 28 of the nut, preventing continued relative rotation therebetween. When the associated nut flats are engaged, a driving connection is provided so that continued rotation of the socket produces corresponding rotation of the nut. Although there may be some tendency for the pins to roll along the surface of the flats 12 a small amount during the initial gripping of the nut, such movement is quite restricted and when the nut is undamaged and provides a good wrenching surface, the pins tend to remain substantially at the corners during the operation of the wrench. In fact, under such conditions, there is no tendency for the pins to move from the corners except to compensate for any deformation in the socket, pins, and fastener as torque is applied.

Figure 9:
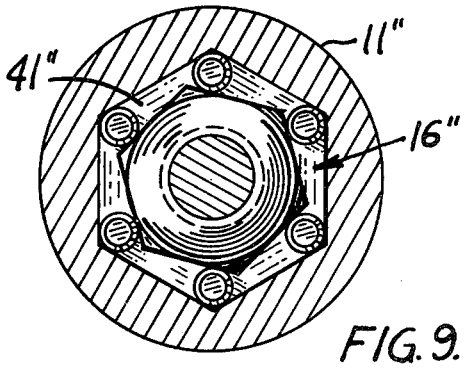
FIG. 9 is an end view of the third embodiment illustrating the adapter in its gripping position.

It is preferable to size the pins so that gripping will occur at a location relatively close to the centers of the flats 26 on the bolt, as illustrated in FIG. 9. However, sufficient clearance must be provided to allow relatively easy positioning of the pins over the nut or bolt, as the case may be.

In the event that the adapted wrench is applied to a nut or bolt head which has been damaged by wearing away of the corners, satisfactory wrenching action is still maintained. For example, if the clearance is such that the pins engage an undamaged portion of the flat, the wrench functions in the manner described above. However, in the event that sufficient damage has occurred to cause the pins to engage the damaged portion of the head, the wrench still functions properly, although it may be necessary to rock the sockets slightly to cause engagement between the damaged head and the rollers for initial gripping. Once the gripping is initiated under such conditions, the pins will, if necessary to provide good gripping action, roll up along the flats 12 in the socket until a location is reached at which proper gripping is achieved. Further, the pins tend to establish a position of alignment or nonalignment, as required, which will cause proper gripping even when the head is badly damaged. Because the retainer is capable of elastic deformation, the retainer allows the pins to move to the proper gripping position in substantially all circumstances.

The adapter within the wrench is also capable of use on round studs. In such instance, it is usually again necessary to tip the socket back and forth as it is rotated to cause the pins to move along the flats in the wrench to a gripping position. Once gripping is initiated, the pins automatically assume the proper position along the flats of the wrench to create the proper gripping for the application of substantial torque. For better gripping, particularly on studs, the pins may be knurled in any suitable manner, as illustrated in FIG. 3 at 15. Such knurling tends to reduce slipping and provides positive gripping. Further, if desired, the pins may be formed with an elliptical or other non-circular cross section to produce a camlike rolling motion to increase the gripping effect. As used herein, the phrase "generally cylindrical" is intended to include such cross sections.

In instances in which the adapter is used with fasteners having undamaged wrenching surfaces, however, the clearances are preferably such that the pins grip the nut or bolt head at a substantial distance from the corner and damage to the bolt or nut therefore does not occur even when large wrenching forces are applied.

FIGS. 5 and 6 illustrate a modified embodiment in which the retainer is formed with a different spring portion. In such embodients, similar reference numerals are used to designate similar parts, but a prime (′) is added to indicate that reference is being made to the second embodiment of FIGS. 5 and 6.

Here again, the pins 14′ are formed with a groove proportioned to receive the mounting portion 18′ of the retainer 16′. However, in this embodiment the spring portion 22′ includes an arcuate portion 36′ connected at its ends to associated radially extending portions 37′. Such arcuate portion is easier to form than the M-shape of the first embodiment. Here again, the retainer is formed of ribbonlike material, which may be spring metal or molded plastic, as desired.

The action in wrenching with the embodiment of FIGS. 5 and 6 is identical to the action described above in connection with the first embodiment.

Figure 7:
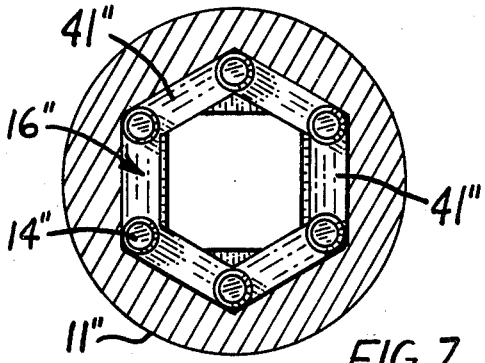
FIG. 7 is an end view of a third embodiment adapter installed in a typical socket wrench.
Figure 8:
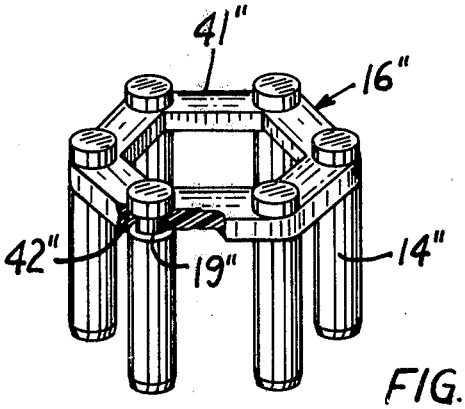
FIG. 8 is a perspective view of the adapter of the third embodiment of FIG. 6.

FIGS. 7 through 9 illustrate still another embodiment of this invention. In this embodiment, similar reference numerals are again used to designate similar parts, but a double prime (″) is added to indicate reference to the embodiment of FIGS. 6 and 7.

In this embodiment, the pins 14″ are again retained in a retainer 16″. However, the retainer of this embodiment is preferably molded from an elastomeric material such as urethane rubber, and is provided with a rectangular or square cross section. The retainer includes six substantially straight retainer legs 41″ which are formed with apertures 42″ at their intersections. The apertures again fit into grooves 19″. Here again, the retainer is sized to provide a light friction with the socket wrench so that the retainer is frictionally retained in the socket wrench 11'' but can be easily inserted or removed.

The retainer 16'' has the advantage of providing a relatively simple geometric form which can be relatively easily molded and the resiliency of the retainer 16'' is provided by the elastomeric material itself. Moreover, this embodiment does not require a serpentine spring portion.

The illustrated retainer 16'' provides an interior hex-shape and exterior hex-shape, but if increased spring action is required, the center portions of the legs can be thinned or bowed, as desired, to increase resiliency. Again, the action of the adapter in the manner in which the pins clamp a workpiece is identical to that described above in connection with the first embodiment.

Figure 10:
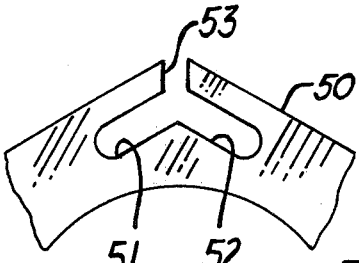
FIG. 10 is a fragmentary plan view of still another embodiment providing a slot along which pins can move into proper gripping engagement.

FIG. 10 illustrates still another embodiment in which a hexagonal retainer 50 is formed with slots 51 and 52 intersecting at 53 adjacent to the corners of the retainer. Such slots extend parallel to associated socket flats and cooperate to provide a generally V-shaped guideway along which pins are free to move for gripping. Here again, the pins are formed with a groove which fits into the slots to axially retain the pins.

When the retainer is formed of substantially rigid material, a radial passage 54 is provided through which the pins are moved during assembly. When the retainer 50 is formed of elastic material, the passage 54 is not required. In this embodiment, the pins are not resiliently maintained at the corners and there is no significant resistance tending to prevent movement from the corners during gripping.

The following table illustrates the size of pins which may be used to convert an inch-size wrench set to metric size. It should be noted that only four different pin diameter sizes are required to accommodate eight different fastener sizes within the metric size system.

| Nominal Diameter and Pitch Standard Metric Threads | Standard Metric Hex Dimension | "Inch" Socket Size | Pin Diameter Required |
|---|---|---|---|
| M5 × 0.8 | 8 mm | 7/16 | .075" |
| M6.3 × 1.0 | 10 mm | ½ | .075 |
| M8 × 1.25 | 13 mm | 11/16 | .119 |
| M10 × 1.5 | 15 mm | ¾ | .119 |
| M12 × 1.75 | 18 mm | ⅞ | .119 |
| M14 × 2.0 | 21 mm | 1⅛ | .198 |
| M16 × 2.0 | 24 mm | 1 5/16 | .240 |
| M20 × 2.5 | 30 mm | 1½ | .240 |

Although all illustrated embodiments provide adapters providing six pins installed in socket wrenches having hexagonal wrenching openings, such adapters may also be used in twelve-point socket wrenches. Further, the adapters may also be used in box wrenches. However, in such wrenches, it may be necessary to hold the adapter in position as it is positioned over the fastener. Still further, it is within the broader scope of this invention to provide adapters with three symmetrically positioned pins for use with hexagonal wrenches and fasteners. However, greater torque capacity is provided when the adapter provides six pins. Further, in instances in which the invention is applied to square bolts, it is preferable to use an adapter having four pins therein.

With the present invention a low-cost adapter system is provided to permit conversion of wrench sets from one size type to another size type. At the current time, when the metric system is being introduced, the largest use will tend to be in converting inch wrench sets to metric sizes. However, as time goes on and the metric size system becomes dominant, this invention will still be highly desirable. At such time when metric wrench sets are most commonly available, it will still be necessary occasionally to have the capacity to work with inch size fasteners which still will exist. In such instance, the adapters will preferably be sized to convert metric size wrench sets to inch size work.

Although the preferred embodiments of this invention have been shown and described, it should be understood that various modifications and rearrangements of the parts may be resorted to without departing from the scope of the invention as disclosed and claimed herein.

What is claimed is:

1. A wrench adapter for wrenches having a regular polygonal wrenching opening therein which provides flats and corners at the intersection of adjacent flats, comprising a plurality of generally cylindrical rigid pins, and a retainer connecting said pins, said retainer positioning said pins in an array in which said pins are substantially parallel and are symmetrically positioned about a central axis, said adapter being insertable into and removable from such wrenching opening with said pins positioned in said corners thereof, said adapter permitting use of a wrench on fasteners having a size different from the size of the wrenching opening therein, said pins being operable to engage associated flats of such an opening and adjacent surfaces of such a fastener and upon such engagement being operable to transfer substantial torque applied to such wrench to such fastener.

2. A wrench adapter as set forth in claim 1, wherein said adapter is sized to provide sufficient friction with said wrenching opening to normally retain said adapter therein.

3. A wrench adapter as set forth in claim 1, wherein said pins have a diameter proportioned to fit fasteners of one size system when positioned in wrenches of a different size system.

4. A wrench adapter as set forth in claim 1, wherein said pins have a diameter proportioned to fit a metric size fastener when positioned in an inch size wrench.

5. A wrench adapter as set forth in claim 1, wherein said pins have a diameter proportioned to fit an inch size fastener when positioned in a metric size wrench.

6. A wrench adapter as set forth in claim 1, wherein said pins have a diameter proportioned to fit fasteners having a polygonal wrenching portion with damaged corners.

7. A wrench adapter as set forth in claim 1, wherein said pins have a diameter proportioned to cause gripping of a circular cross section element such as a round stud or the like.

8. A wrench adapter as set forth in claim 1, wherein said pins are formed with a knurl to increase gripping of fasteners or the like.

9. A wrench adapter as set forth in claim 1, wherein said retainer is formed with slots adapted to extend along associated flats along which said pins are movable toward and away from said corners.

10. A wrench adapter as set forth in claim 1, wherein said retainer is resilient and allows said pins to move from said corners along said flats.

11. A wrench adapter as set forth in claim 10, wherein said retainer provides mounting portions extending around said pins through an angle exceeding 180 degrees and provides serpentine spring portions joined at their ends to adjacent mounting portions.

12. A wrench adapter as set forth in claim 11, wherein said spring portions are M-shaped.

13. A wrench adapter as set forth in claim 11, wherein said retainer is molded from plastic.

14. A wrench adapter as set forth in claim 11, wherein said retainer is formed of spring metal.

15. A wrench adapter as set forth in claim 1, wherein said pins provide grooves substantially adjacent to one end and said retainer fits into said grooves.

16. A wrench adapter as set forth in claim 1, wherein said retainer is molded from elastomeric material.

17. A wrench adapter as set forth in claim 16, wherein said pins are formed with grooves substantially adjacent to one end and said elastomeric material extends into said grooves.

18. A wrenching system comprising a wrench formed with a wrench opening therein providing a plurality of flats and a plurality of corners at the intersections of adjacent flats, an adapter in said opening providing a plurality of rigid cylindrical pins positioned at said corners, said pins operating to grip the surface of a fastener when torque is applied to said wrench and providing a driving connection between said wrench and fastener.

19. A wrenching system as set forth in claim 18, wherein said adapter includes a retainer connected to said pins and maintaining said pins in a symmetrical array about an axis, and in which said pins are substantially parallel, said adapter being removably installed in said wrench opening.

20. A wrenching system as set forth in claim 19, wherein said retainer is resilient and permits movement of said pins away from said corners in said wrench.

21. A wrench adapter for socket wrenches or the like, wherein the wrench provides a wrench opening having at least six corners formed by intersecting flats, said adapter comprising six pins and a retainer interconnecting said pins and positioning them in a parallel array symmetrical about an axis, said pins providing grooves substantially adjacent one end thereof, a retainer fitting said grooves and being sufficiently resilient to allow radial movement of said pins, said adapter being insertable into and removable from said wrenching opening with said pins located in said corners and providing sufficient friction to normally retain said adapter in said wrench opening, said socket providing a radially extending end wall limiting inward movement of said adapter to an installed position in which the outer ends of said pins are substantially adjacent to the outer ends of said socket.

22. A wrench adapter as set forth in claim 21, wherein said pins are sized to convert said wrench between inch and metric sizes.

* * * * *